US009598220B2

(12) United States Patent
Kim et al.

(10) Patent No.: US 9,598,220 B2
(45) Date of Patent: Mar. 21, 2017

(54) COSMETIC CONTAINER WITH DIFFERENT TYPES OF MIXED MATERIALS

(71) Applicants: AMOREPACIFIC CORPORATION, Seoul (KR); HANA CO., LTD, Hwaseong-si (KR)

(72) Inventors: Joon Young Kim, Seoul (KR); Oh Soo Lee, Seoul (KR); Sung il Kang, Sungnam-si (KR)

(73) Assignee: AMOREPACIFIC CORPORATION, Yongsan-gu, Seoul (KR)

( * ) Notice: Subject to any disclaimer, the term of this patent is extended or adjusted under 35 U.S.C. 154(b) by 153 days.

(21) Appl. No.: 14/438,569

(22) PCT Filed: Oct. 15, 2013

(86) PCT No.: PCT/KR2013/009175
§ 371 (c)(1),
(2) Date: Apr. 24, 2015

(87) PCT Pub. No.: WO2014/073795
PCT Pub. Date: May 15, 2014

(65) Prior Publication Data

US 2015/0274398 A1 Oct. 1, 2015

(30) Foreign Application Priority Data

Nov. 7, 2012 (KR) ..... 20-2012-0010146 U

(51) Int. Cl.
*B67D 7/74* (2010.01)
*B65D 81/32* (2006.01)
(Continued)

(52) U.S. Cl.
CPC ..... *B65D 81/325* (2013.01); *A45D 34/00* (2013.01); *A45D 34/04* (2013.01); *A45D 40/24* (2013.01);
(Continued)

(58) Field of Classification Search
CPC ..... B65D 81/325; A45D 34/00
(Continued)

(56) References Cited

U.S. PATENT DOCUMENTS 5,875,889 A * 3/1999 Albisetti ..... B65D 1/06 206/221
6,293,433 B1 * 9/2001 Joulia ..... B65D 25/08 206/221

FOREIGN PATENT DOCUMENTS

JP 2007-039069 2/2007
JP 2010-036922 A 2/2010
(Continued)

*Primary Examiner* — Patrick M Buechner
*Assistant Examiner* — Jeremy W Carroll
(74) *Attorney, Agent, or Firm* — East West Law Group; Heedong Chae

(57) ABSTRACT

Disclosed is a dissimilar content mixing cosmetic container, including a dual container body, an airless pump, and a push button, wherein, a dissimilar content receiving means, which raises a mixing member by a repulsive force of a resilient member caused by releasing of a catching boss of the mixing member, damages a sealing plate of a first content receiving means, presses contents2 received in the dissimilar content receiving means, and discharges the contents2 within contents1 received in the dual container body to be mixed, is provided, and contents3 are discharged by a push operation of the airless pump.

10 Claims, 12 Drawing Sheets

(51) Int. Cl.

| | |
|---|---|
| ***A45D 40/24*** | (2006.01) |
| ***A45D 34/00*** | (2006.01) |
| ***A45D 34/04*** | (2006.01) |
| ***B65D 83/00*** | (2006.01) |

(52) U.S. Cl.
CPC .... *B65D 83/0005* (2013.01); *A45D 2200/054* (2013.01); *A45D 2200/055* (2013.01); *A45D 2200/056* (2013.01); *A45D 2200/058* (2013.01)

(58) Field of Classification Search
USPC ..... 222/129, 135; 215/DIG. 8
See application file for complete search history.

(56) References Cited

FOREIGN PATENT DOCUMENTS

| | | | |
|---|---|---|---|
| KR | 20-0322753 | Y1 | 8/2003 |
| KR | 20-0384766 | Y1 | 5/2005 |
| KR | 20-042638 | Y1 | 11/2008 |
| KR | 10-2011-0016832 | A | 2/2011 |

* cited by examiner

PRIOR ART

PRIOR ART

COSMETIC CONTAINER WITH DIFFERENT TYPES OF MIXED MATERIALS

BACKGROUND OF THE INVENTION

1. Field of the Invention

The present invention relates to a dissimilar content mixing cosmetic container, more particularly to, a dissimilar content mixing cosmetic container in which dissimilar contents are stored in different places, the dissimilar contents are mixed before being discharged to be used, and then the mixed contents are discharged through a singular discharging passage by a singular pumping operation.

2. Description of the Prior Art

In a case of cosmetics of which contents are in a gelled state that is liquid or has low viscosity, such as lotion, cream, gel, shampoo, and rinse, an airless pump is received in a cosmetic container thereof to discharge the cosmetics to be used.

The cosmetic container for receiving the cosmetics having such coefficient of viscosity is designed to discharge the received contents by a small amount, and is particularly applied to a container in which functional cosmetics are received.

Further, the airless pump applied to the cosmetic container is used in a dissimilar content mixing cosmetic container which mixes and discharges two dissimilar contents. In other words, there are products having an improved effect when dissimilar contents are mixed to be used, as one kind of functional cosmetics. The airless pump is mounted to a container of the functional cosmetics to discharge the contents.

FIG. 1 illustrates a dissimilar content mixing cosmetic container according to the related art through which dissimilar two contents are mixed and discharged. As illustrated, the dissimilar content mixing cosmetics container 10 according to the related art includes a container body 11, airless pumps 12*a* and 12*b*, pistons 13*a* and 13*b*, and a push button 14.

An inner space of the container body 11 is divided into two receiving portions 11*b* and 11*c* by a partition, dissimilar two contents are stored in the two receiving portions 11*b* and 11*c*, and openings for discharging the contents to the outside are formed at upper portions of the two receiving portions 11*b* and 11*c*. An opened lower portion of the container body 11 is sealed from the outside by a closure cap 11*d*.

The pair of airless pumps 12*a* and 12*b* are mounted to upper portions of the two receiving portion 11*a* and 11*b* of the container body 11. That is, the pair of airless pump 12*a* and 12*b* are mounted in areas adjacent to the openings of the two receiving portion 11*a* and 11*b*, respectively.

The pistons 13*a* and 13*b* are formed as a pair, and the pair of pistons 13*a* and 13*b* are installed in the two receiving portions 11*a* and 11*b* of the container 11, respectively. The pistons 13*a* and 13*b* moves upward in the receiving portion 11*a* and 11*b* in conjunction with operations of the airless pumps 12*a* and 12*b*, and the pistons 13*a* and 13*b* moving upward push the contents in the receiving portion 11*a* and 11*b*.

The push button 14 is installed at an upper side of the airless pumps 12*a* and 12*b* to press the airless pumps 12*a* and 12*b*, and has a structure in which an ingredient discharged from the two receiving portions 11*a* and 11*b* of the container body 11 leads different two contents, and then mixes and discharges the contents.

Next, an operation of the dissimilar content mixing cosmetic container configured above according to the related art will be described with reference to FIG. 2.

First, when a user push the push button 14 to pump the airless pumps 12*a* and 12*b* located at the receiving portions 11*a* and 11*b*, pressure is generated within pump cylinders 18*a* and 18*b* and content feeding passages of piston rods 16*a* and 16*b* are secured. Accordingly, contents filled in the pump cylinders 18*a* and 18*b* pass through discharging tubes 15*a* and 15*b* and are discharged though discharging holes 14*a* and 14*b* communicating with the discharging tubes 15*a* and 15*b*. At this time, opening/closing balls of the pump cylinders 18*a* and 18*b* block inlet holes 19*a* and 19*b*.

In this way, when the contents are discharged by pushing the push button 14 and then an external force applied to the push button 14 is removed, the piston rods 16*a* and 16*b* receiving repulsive forces of the springs 17*a* and 17*b* move upward to its original place, and vacuum pressure is generated within the pump cylinders 18*a* and 18*b*. Thus, the opening/closing balls are spaced apart from the inlet holes 19*a* and 19*b* so that inlet passages are secured. Interiors of the pump cylinders 18*a* and 18*b* are filled with contents of the receiving portion 11*a* and 11*b* through the secured inlet passages.

Through the above-described process, the dissimilar contents received in the two receiving portion 11*a* and 11*b* of the container body 11 are discharged and mixed in an equivalent (equal) proportion and then are finally discharged to the outside.

However, in the dissimilar content mixing cosmetic container according to the related art, since the dissimilar contents discharged through the respective airless pumps are mixed in the discharging passages of the push button which have a short and rectilinear shape, and are then discharged, the finally-discharged contents corresponds to contents obtained by not evenly mixing the two contents.

Accordingly, a user should mix the finally-discharged contents one more times in order to use the finally-discharged contents. When the user feels annoyingness so that the user roughly mixes the finally-discharged contents in order to use the finally-discharged contents, a functional deterioration and a functional disorder of the contents occur.

Further, since the dissimilar content mixing cosmetic container according to the related art has a configuration in which airless pumps are mounted to two receiving portion receiving the dissimilar contents, mixing of the two contexts may be performed in a proper proportion only when the two airless pumps maintain their pumping function which the airless pumps have when they are initially manufactured.

That is, when a function of any one of the two airless pumps deteriorates during use, contents of the corresponding receiving portion are discharged by an amount different from a discharged amount of the initially-manufactured container. Accordingly, the dissimilar contents cannot be mixed in a proper proportion so that a functional deterioration and a functional disorder of the finally-discharged contents occur.

Further, in the dissimilar content mixing cosmetic container according to the related art, mixing of the two contents can be performed in a proper proportion only when a same force is always applied to the two airless pumps.

In other words, when a pushing force is eccentrically applied to the push button, a force applied to any one of the two airless pumps becomes strong so that a relatively large amount of the contents are discharged through the corresponding airless pump and a relatively small amount of the contents are discharged through the other airless pump at the same time.

As a result, the dissimilar contents cannot be mixed in a proper proportion so that that a functional deterioration and a functional disorder of the finally-discharged contents occur.

Further, since the dissimilar content mixing cosmetic container according to the related art has a configuration in which two airless pumps and two pistons are required, a structure thereof is complex, thereby causing an increase in manufacturing costs and an increase in a product price.

SUMMARY OF THE INVENTION

Accordingly, the present invention has been made in an effort to solve the above-described problems, and it is an object of the present invention to provide a dissimilar content mixing cosmetic container in which dissimilar contents are stored in different places, the dissimilar contents are mixed by one touch manipulation when the container is initially used, and then the mixed contents are discharged through one discharging passage by one pumping operation.

In accordance with one aspect of the present invention, there is provided a dissimilar content mixing cosmetic container, including a dual container body, an airless pump, and a push button, wherein a dissimilar content receiving means, which raises a mixing member by a repulsive force of a resilient member caused by releasing of a of the mixing member, damages a sealing plate of a first content receiving means, presses contents2 received in the dissimilar content receiving means, and discharges the contents2 within contents1 received in the dual container body to be mixed, is provided, and contents3 are discharged by a push operation of the airless pump.

The present invention made by the above-described problem solving means corresponds to a dissimilar content mixing cosmetic container in which dissimilar contents are stored in different places, the dissimilar contents are mixed by one touch manipulation when the container is initially need, and then the mixed contents are discharged through one discharging passage by one pumping operation, so that the dissimilar contents are discharged in a state of being mixed in an uniform proportion and the usability thereof is improved.

Further, the present invention can mix and discharge the dissimilar contents divided and stored in a same container even while including one airless pump and one piston, so that a structure thereof becomes simply and manufacturing costs can foe reduced according to the simply structure.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, exemplary embodiments of the present invention will be described with reference to the accompanying drawings.

Figure 1:
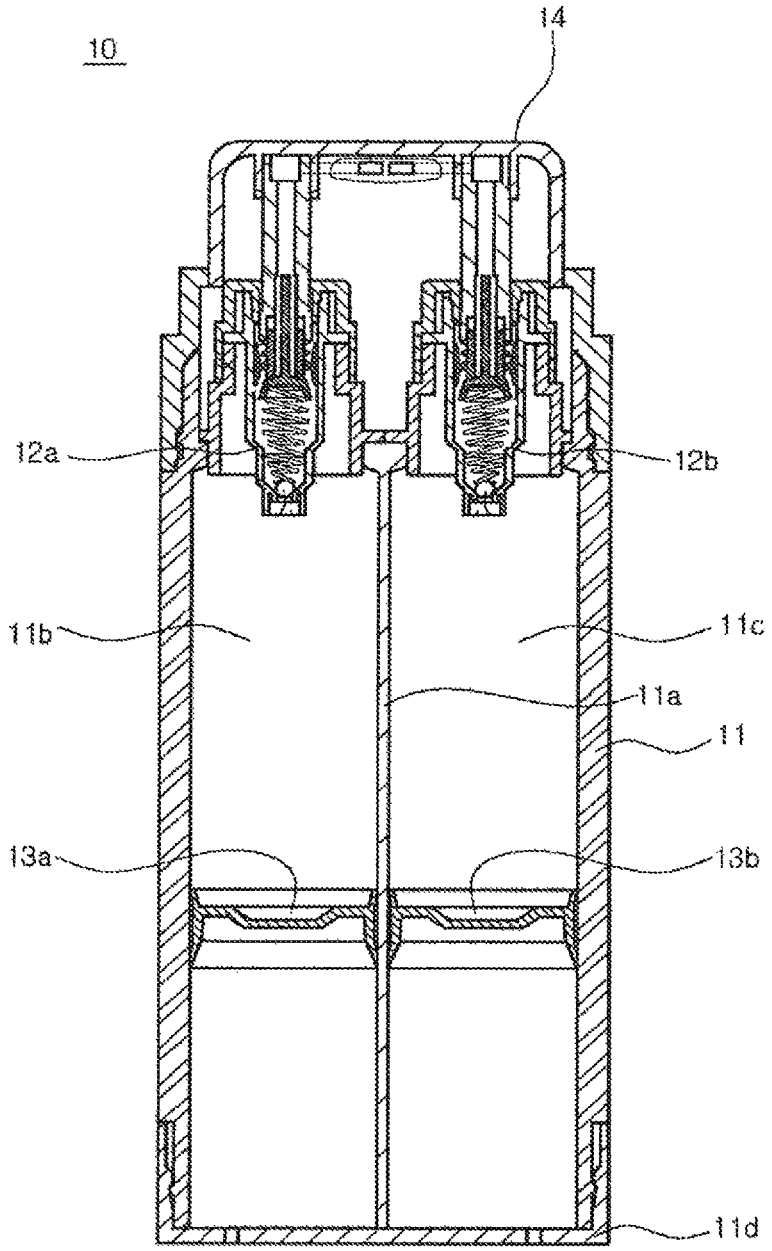
FIG. 1 is a sectional view illustrating a configuration of a dissimilar content mixing cosmetic container according to the related art.
Figure 2:
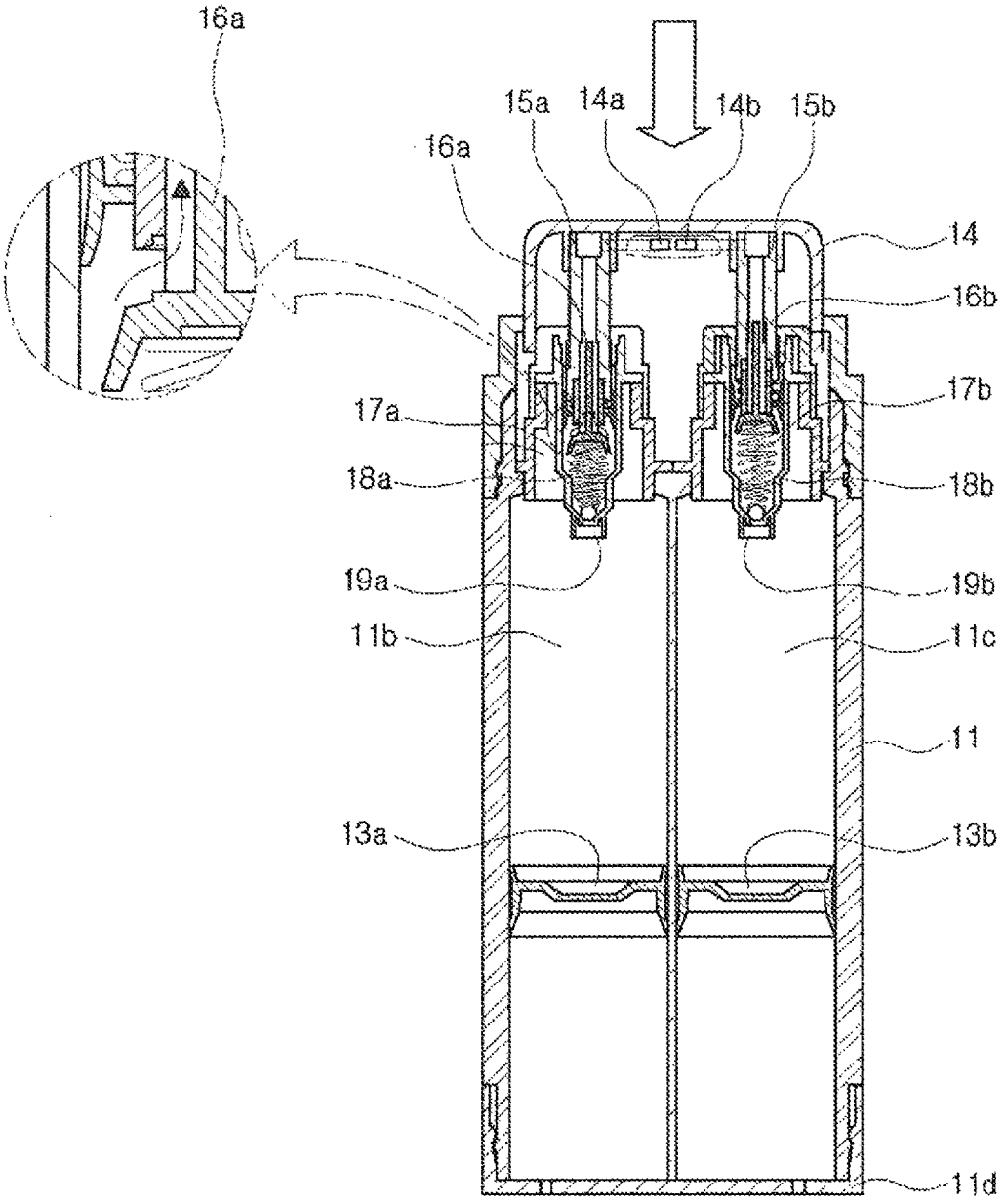
FIG. 2 illustrates an operation of a dissimilar content mixing cosmetic container according to the related art.
Figure 3:
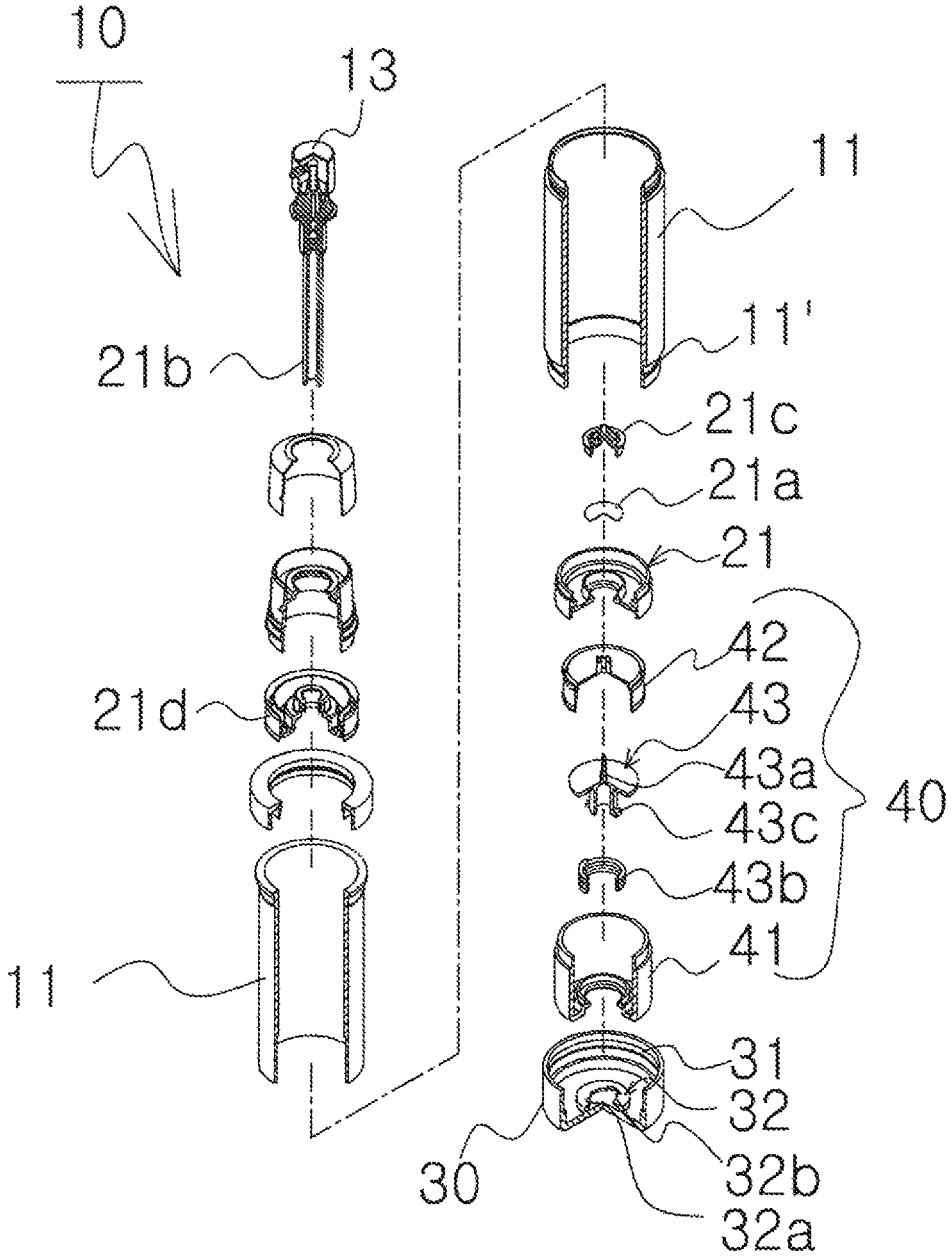
FIG. 3 is an exploded perspective view illustrating a whole configuration of a dissimilar content mixing cosmetic container according to an embodiment of the present invention.
Figure 4:
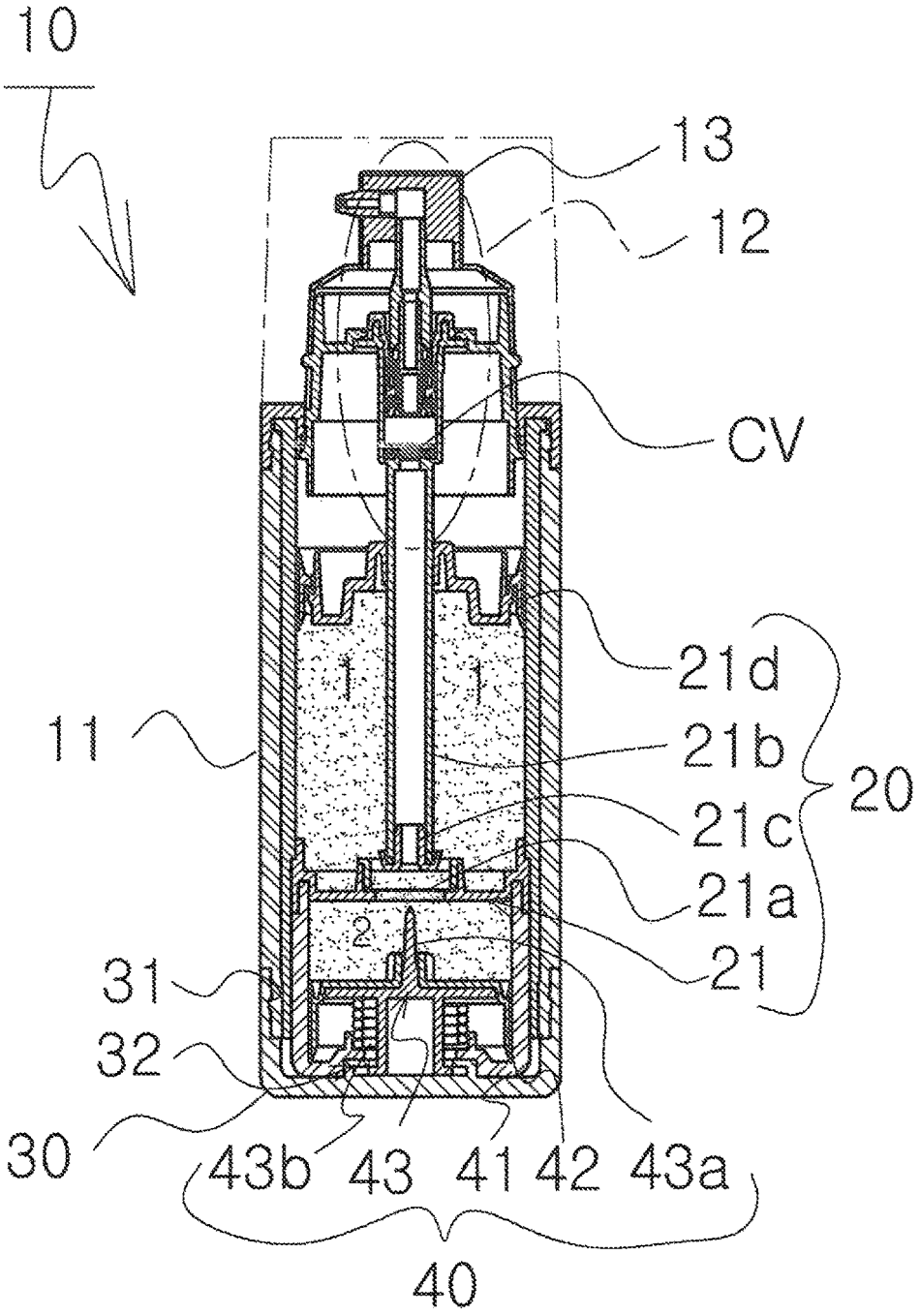
FIG. 4 is a sectional view illustrating a whole configuration of a dissimilar content mixing cosmetic container according to an embodiment of the present invention.

As shown in FIGS. 3 and 4, there is provided a dissimilar content mixing cosmetic container 10 including a dual container body 11, an airless pump 12, and a push button 13, in which a dissimilar content receiving means 40, in which a mixing member 43 is raised by a repulsive force of a resilient member 43*b* caused by release of a catching boss 43*c* of the mixing member 43, a perforation, pin 43*a* damages a sealing plate 21*a* to press contents2 2 received in the dissimilar content receiving means 40, and the contents2 2 are discharged within contents1 1 received in the dual container body 11 to be mixed, is provided, and contents3 3 are discharged by a push operation of the airless pump 12.

The dual container body 11 may have a structure of which one side is opened and the other side is a singular sealed cylindrical body. Further, the dual container body 11 may have a structure of which opposite sides correspond to opened cylindrical bodies and a lower end of one side is coupled to a lower cap 30 to be sealed.

Herein, a rotational groove 31 formed at an inner peripheral portion of the lower cap is rotatably coupled to a guide boss 11' at an outer peripheral portion of the dual container body 11.

Further, a catching member 32, in which opened recesses 32*a* and catching bosses 32*b* are repeatedly and circumferentially provided, is formed at an inner central portion of the lower cap 30.

The dissimilar content receiving means 40 is provided at a discharging lower portion of the dual container body 11. The dissimilar content receiving means 40 is coupled to an inner diameter of the dual container body 11, a lower end of the dissimilar content receiving means 40 is coupled to an interior of the lower cap 30, the contents2 2 are received in the dissimilar content receiving means 40, and the mixing member 43 raising a piston 42 by a resilient force caused by releasing a fixed state when the lower cap 30 is rotated is provided in the dissimilar content receiving means 40.

The dissimilar content receiving means 40 includes a contents2 housing 41 for receiving the contents2 2, the piston 42 for raising and discharging the contents while maintaining sealing of the contents2 2, and the mixing member 43 provided within the piston 42, having the perforation pin 43*a* at an upper central portion thereof, receiving the resilient member 43*b* at a lower side thereof, and including the catching boss 43*c* at a lower end thereof.

Here, one end of the perforation pin 43*a* may be so sharp as to easily perforate a thin plate, and a cross section of the perforation pin 43*a* may be "+" shape.

A first content receiving means 20 is coupled and fixed to an inner diameter of the dual container body 11, and is coupled to an upper end of the contents2 housing 41. The sealing plate 21*a* for sealing the contents2 2 received in the dissimilar content receiving means 40 is disposed at a central lower side of a dissimilar content sealing member 21 as means for storing the contents2 2 such that the contents2 2 is isolated from the content1 1. A perforation pin guide member 21*c* coupled to an upper side of the dissimilar content sealing member 21 and coupled to a lower end of the mixing discharging tube 21*b*, for guiding raising of the perforation pin 43*a* is provided. The perforation pin guide member 21*c*. The perforation pin guide member 21*c* presses the sealing plate 21*a* downward and fixes the sealing plate 21*a* while being coupled to the dissimilar content sealing member 21.

Here, the sealing plate 21*a* may be vinyl or polyethylene. The sealing plate 21*a* is not limited thereto, and a material which has a property by which liquid can be excellently sealed and is easily torn by the perforation pin 43*a* may be employed as the sealing plate 21*a*.

Further, a piston 21*d* which is raised by an amount of the contents2 2 introduced when the contents2 2 are introduced and mixed while sealing of the contents1 1 is maintained is provided at an upper outer peripheral, portion of the mixing discharging tube 21*b*.

Figure 10:
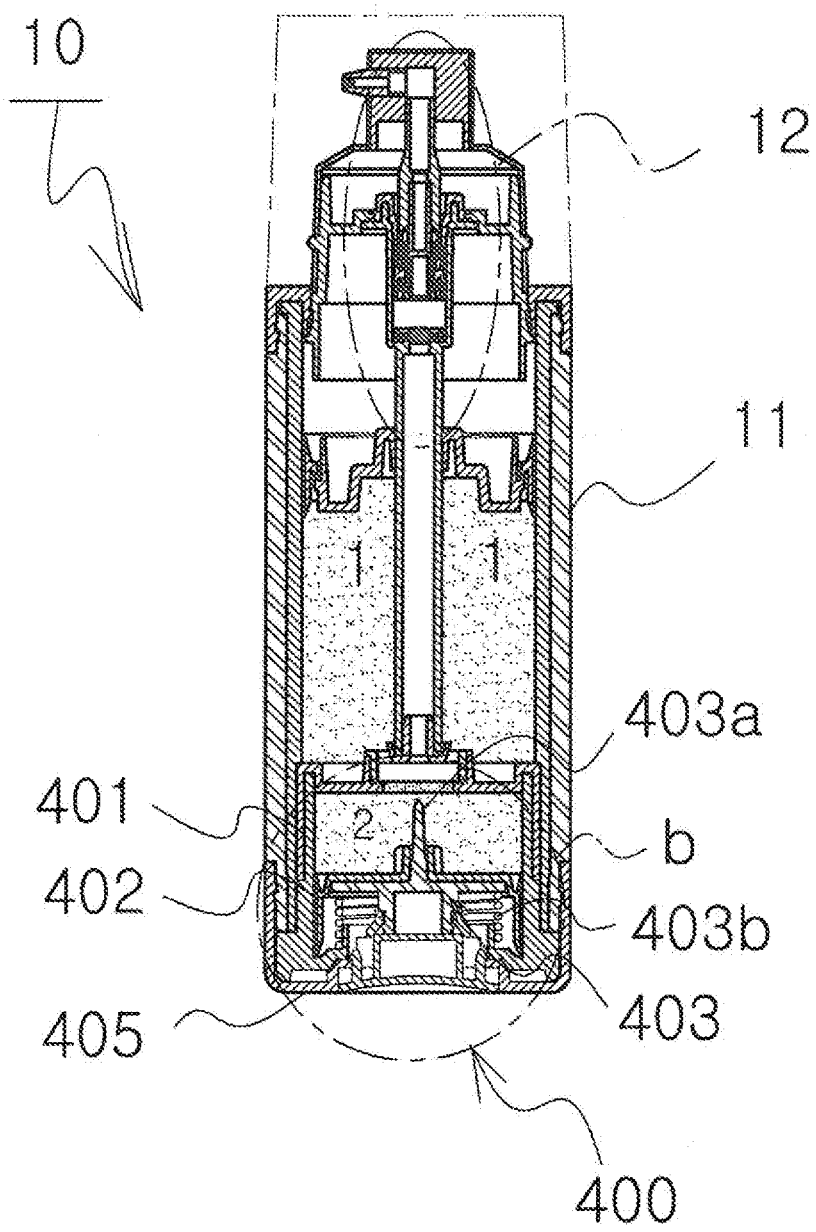
FIG. 10 is a sectional view illustrating a dissimilar content mixing cosmetic container according to another embodiment of the present invention.
Figure 11:
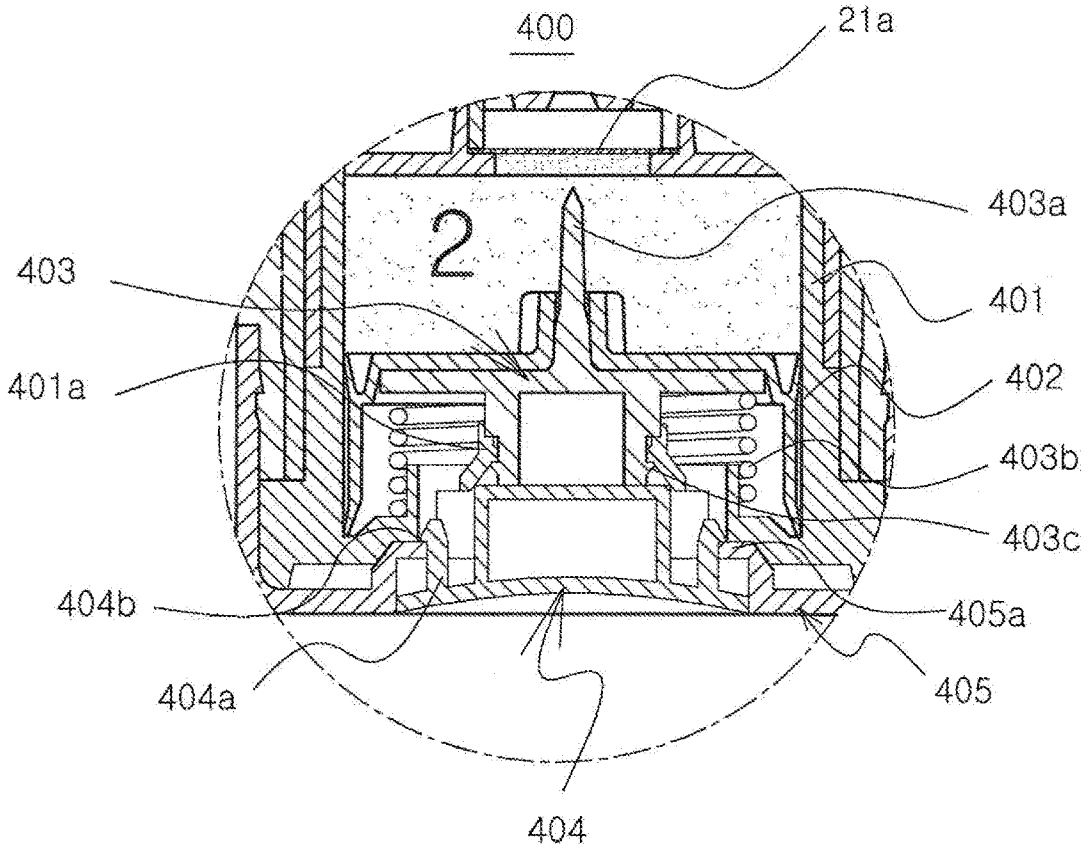
FIG. 11 is an expanded sectional view illustrating a part b of FIG. 10.
Figure 12:
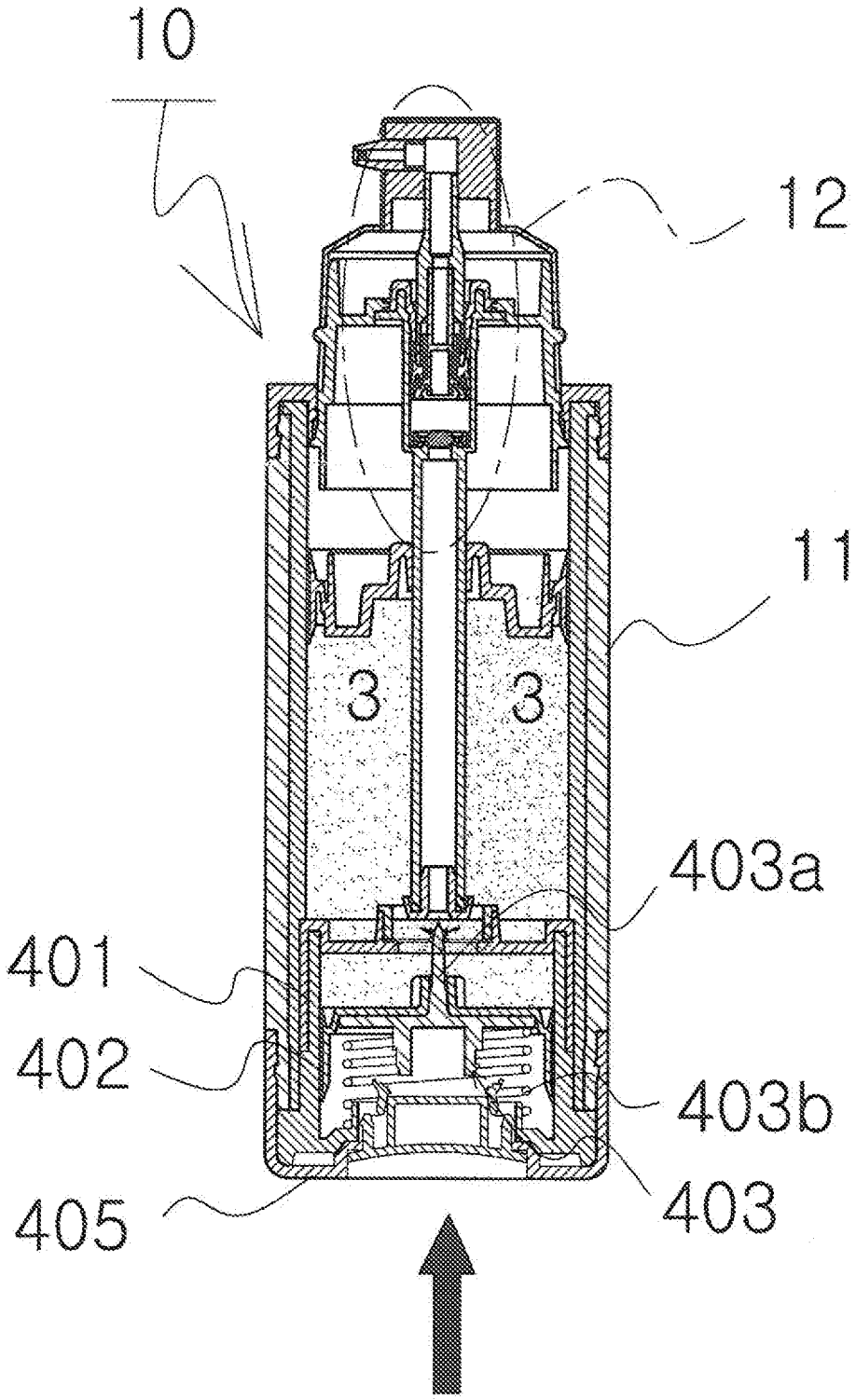
FIG. 12 illustrates an operation state of a dissimilar content mixing cosmetic container according to another embodiment of the present invention.

As another embodiment of the dissimilar content receiving means 40, as shown in FIG. 10, the dissimilar content receiving means 400 includes a contents2 housing 401 for receiving contents2 2, and a piston 402 for raising and discharging the contents while maintaining sealing of the contents2, and a mixing member 403 is provided within the piston 402, has a perforation pin 403*a* at an upper central portion thereof, receives a resilient member 403*b* at a lower side thereof, and includes a catching step 403*c* at a lower end thereof.

Further, the catching member 401*a* formed to correspond to the catching step 403*c* is formed at a center of the contents2 housing 401.

Meanwhile, a pushing pressing member 404, which divides the catching member 401*a* into opposite sides when an upward artificial force is pressed while being on standby at a lower end of the mixing member 403, to release braking of the mixing member 403, so as to raise the mixing member 403, is provided at a lower end of the mixing member 403.

Here, the pushing pressing member 404 raises the mixing member 403, and then is pushed and lowered by the catching member 401*a* while going back to its original state by a resilient force of the catching member 401*a*, and a catching step 404*b* provided in a rib 404*a* of the pushing pressing member 404 is braked by a braking step 405*a* provided in a lower cap 405.

An operation of the present invention as configured above will be described below.

First, before the contents3 3 are discharged by a pumping operation by the airless pump 12 to be used, the present invention should mix the dissimilar contents, that is, the contents1 1 received in the first content receiving means 20 and the contents2 2 received in a space formed by the dissimilar content receiving means 40.

As shown in FIGS. 5 to 8, in the mixing operation, when the lower cap 30 is rotated (in a clockwise direction or in a counterclockwise direction), the catching boss 43*c* of the mixing member 43 caught at the catching boss 32*b* is located at the opening recess 32*a*.

Then, the catching boss 43*c* controlling the mixing member 43 is released, the mixing member 43 is raised by a resilient force of the resilient member 43*b*, the piston 42 at an outer peripheral surface of the mixing member 43 raises the contents2 2 at the same time, and the perforation pin 43*a* provided at an upper end of the mixing member 43 perforates the sealing plate 21*a* at a center of the dissimilar content sealing member 21 and is guided by the perforation pin guide member 21*c* while moving upward to move into a center of the perforation pin guide member 21*c*.

As described above, when the sealing plate 21*a* is perforated by the perforation pin 43*a*, the contents2 2 passes through the perforated sealing plate 21*a* to be mixed with the contents1 1.

At this time, the contents1 1 may be transparent liquid cosmetics and the contents2 2 may be colored or at least semitransparent cosmetics, so that the two kinds of contents are mixed such that a user feels mystique.

Figure 5:
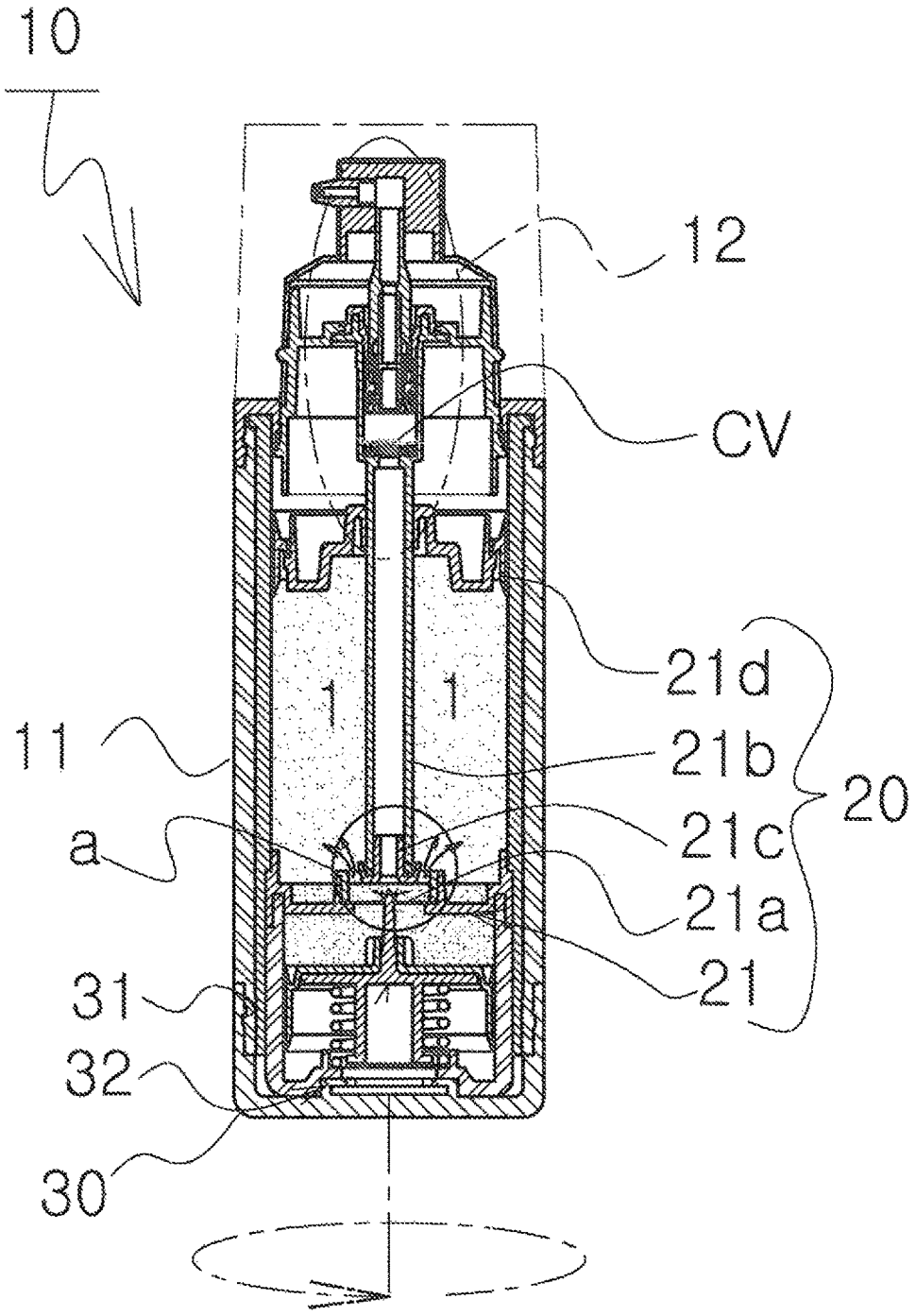
FIGS. 5 to 6 are sectional views illustrating a mixing operation state of dissimilar contents according to an embodiment of the present invention.
Figure 6:
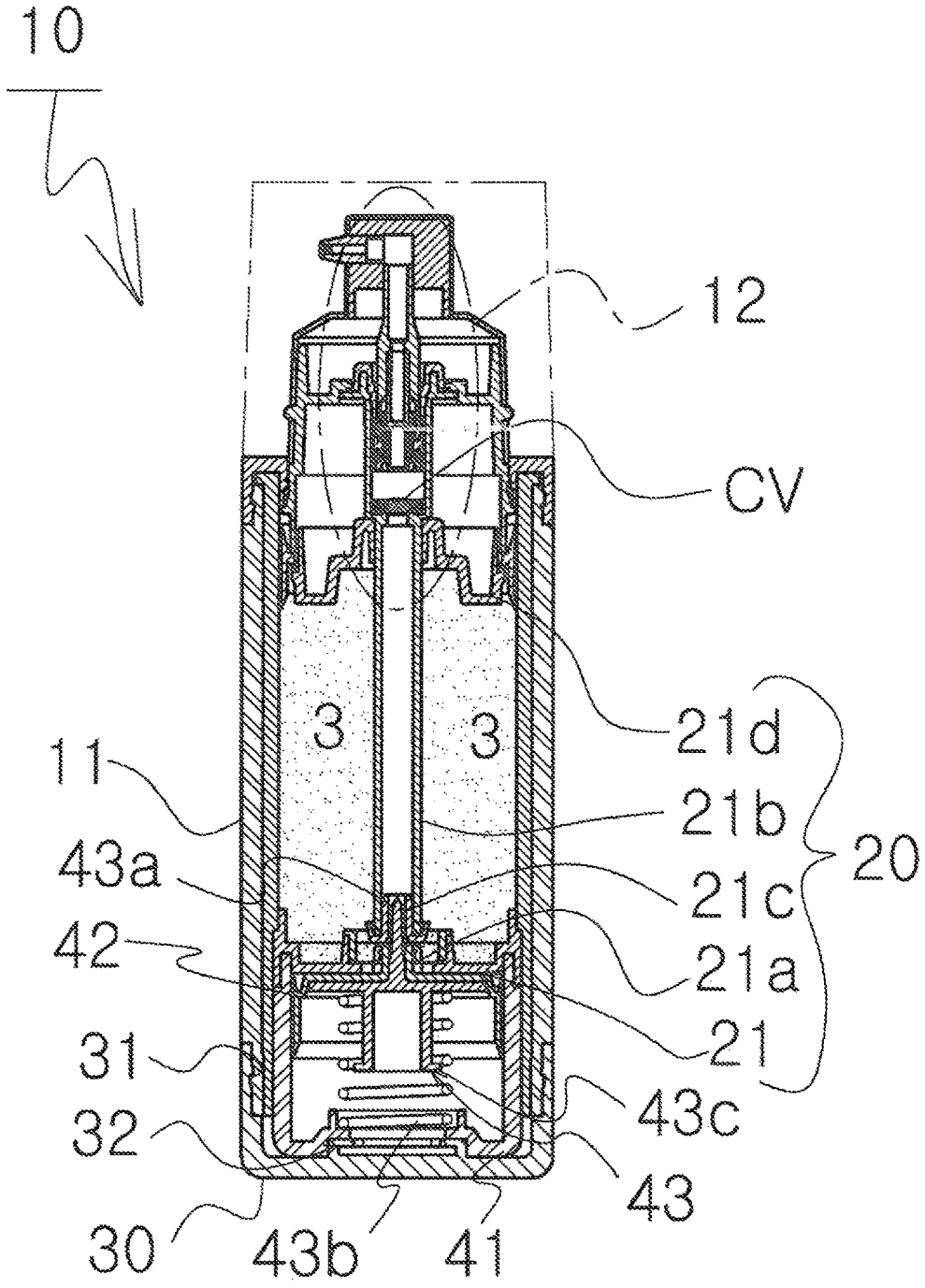
Figure 7:
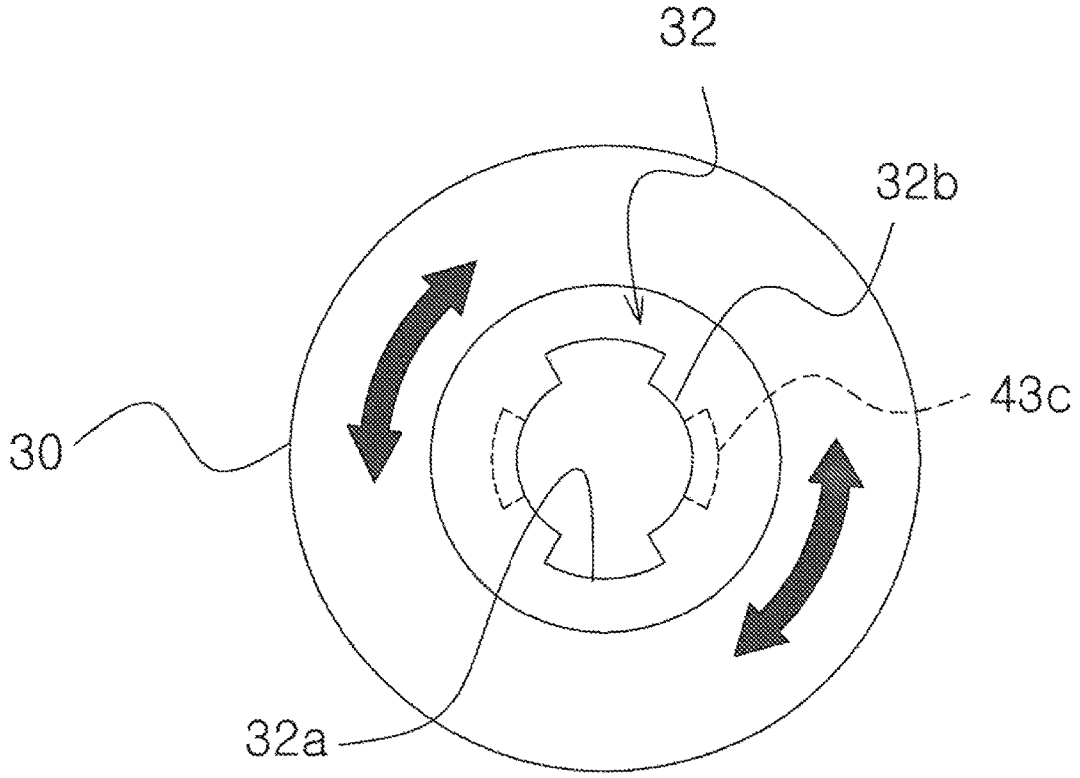
FIG. 7 is a plan view illustrating a main part of a catching member provided within a lower cap according to an embodiment of the present invention.
Figure 8:
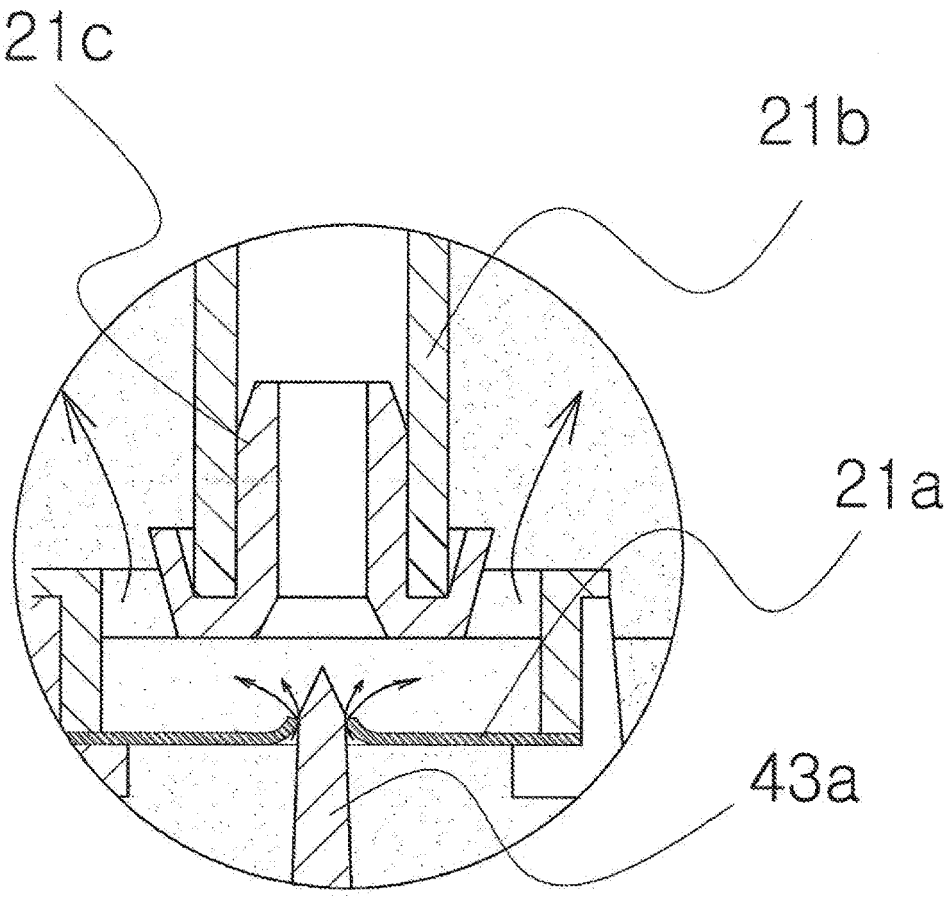
FIG. 8 is an expanded sectional view illustrating a part a of FIG. 5.

As shown in FIG. 6, when an upper horizontal surface of the mixing member 43 contacts a lower horizontal surface of the dissimilar content sealing member 21, all of the contents2 2 received in the contents2 housing 41 move into the contents1 1, are mixed with the contents1 1, and are converted into the contents3 3. The piston 21*d* provided in the mixing discharging tube 21*b* is raised by an amount of the introduced contents2 2 as shown in FIG. 5, and is pushed and raised to a lower end of the airless pump 12 as shown in FIG. 6.

At this time, a check valve located at an upper end of the mixing discharging tube 21*b* is in a blocked state such that the mixed contents should not be discharged.

Figure 9:
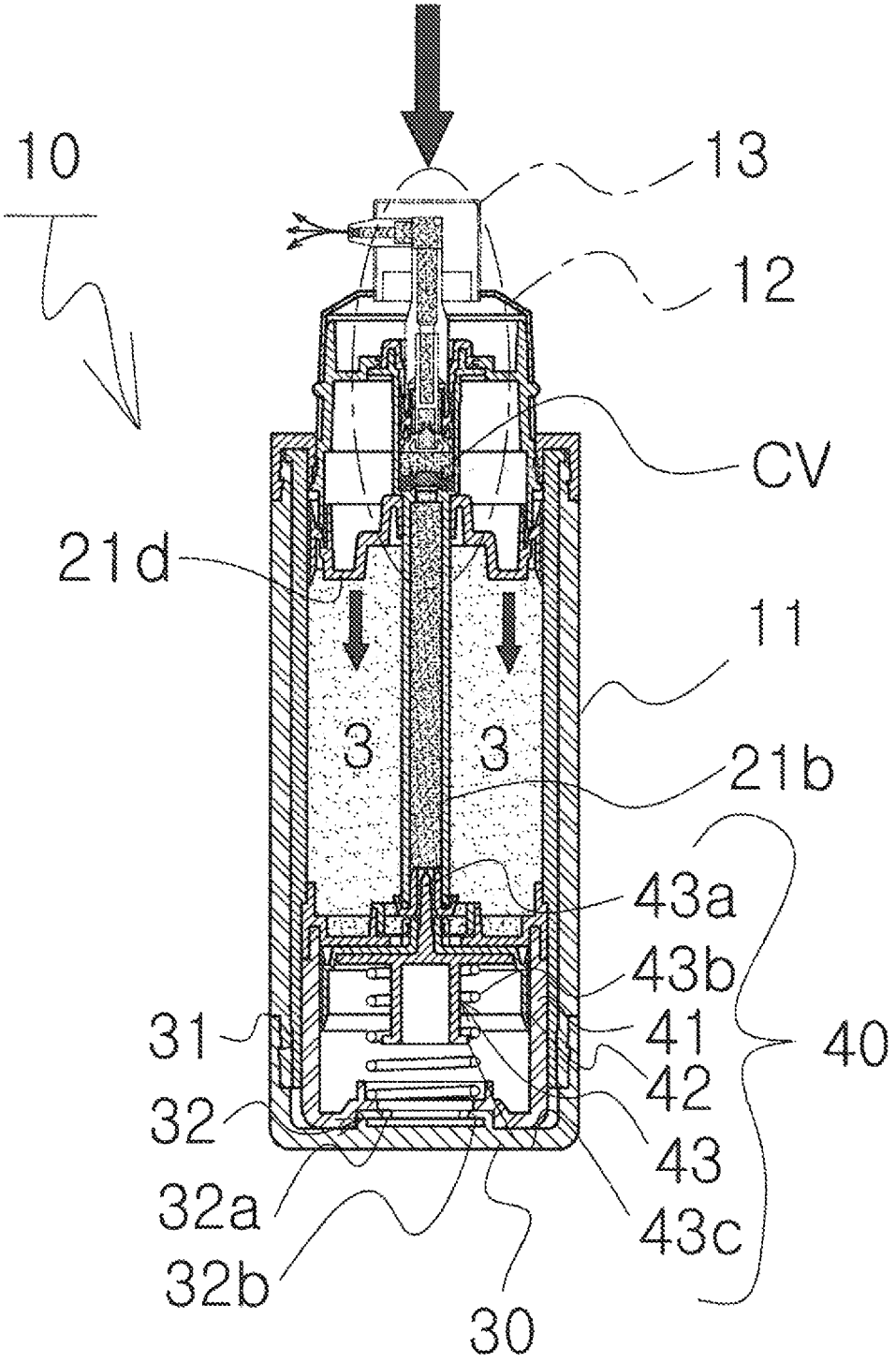
FIG. 9 is a sectional view illustrating the mixed contents are discharged by the pumping operation of airless pump of the present invention

As described above, when a user want to use the contents3 3 obtained by mixing the contents1 1 and the contents2 2, if the user pushes the push button 13 to operate the airless pump 12 as shown in FIG. 9, the contents3 3 are pumped, are raised along a predetermined path, and are discharged through a discharging passage of the push button 13, to be used.

In more detailed description of this operation, when a user pushes the push button 13 such that the airless pump 12 performs a pumping operation, pressure is generated within the pump cylinder and a content feeding passage of the piston rod is secured at the same time. Accordingly, the contents filled within the pump cylinder pass through the discharging tube of the push button 13 and then are discharged through a discharging hole.

At this time, the check vale of the pump cylinder is in a blocked state.

In this way, when an external force applied to the push button is removed after a user pushes the push button 13 to discharge the contents, the piston rod receiving an impulsive force of the spring of the airless pump 12 is raised to its original place and vacuum pressure is generated within the pump cylinder, so that the check valve blocking the inlet hole is spaced so as to secure the inlet passage of the contents.

The contents3 3 in the dual container body 11 are filled in the pump cylinder through the secured inlet passage and the mixing discharging tube 21*b*, and the piston 21*d* is lowered by an amount of the discharged contents3 3.

The present invention is a dissimilar content mixing cosmetic container in which dissimilar contents are stored in different places, the dissimilar contents are mixed by one touch manipulation when the container is initially used, and then the mixed contents are discharged through one discharging passage by one pumping operation, so that the dissimilar contents are discharged in a state of being mixed in an uniform proportion and the usability thereof is improved.

Further, the present invention can mix and discharge the dissimilar contents divided and stored in a same container even while including one airless pump and one piston, so that a structure thereof becomes simply and manufacturing costs can be reduced according to the simply structure.

Above, although the present invention has been described in relation to embodiments for exemplifying principles of the present invention, the present invention is not limited to the configuration and the operation illustrated and described above.

In addition, it can be understood by those skilled in the art that various modifications and changes can be implemented without departing from spirits and scope of appended claims.

Thus, it is regarded that all of the proper changes, modifications, and equivalents also belong to the scope of the present invention.

What is claimed is:

1. A dissimilar contents mixing cosmetic container, comprising a dual container body, an airless pump, and a push button, wherein the dual container body further comprises a dissimilar contents receiving means, which, upon release of a catching boss of a mixing member, raises the mixing member by a repulsive force of a resilient member for the mixing member to damage a sealing member of a first content receiving means, presses the second content received in the dissimilar contents receiving means, and discharges the second content within the first content received in the dual container body to be mixed, and wherein the third content is discharged by a push operation of the airless pump.

2. The dissimilar contents mixing cosmetic container of claim 1, wherein the dissimilar contents sealing member of the first content receiving means is attached to an inner diameter of the dual container body and to an upper end of a second content housing, and the dissimilar contents sealing member comprises a sealing plate for blocking mixing of the first content and the second content.

3. The dissimilar contents mixing cosmetic container of claim 2, wherein the first content receiving means comprises a perforation pin guide member, and the perforation pin guide member presses the sealing plate downward and fixes the sealing plate while being coupled to the dissimilar contents sealing member.

4. The dissimilar contents mixing cosmetic container of claim 1, wherein the dual container body has a structure in which opposite ends thereof correspond to opened cylindrical bodies, a lower end of one end thereof is coupled to a lower cap, and a rotational groove formed at an inner peripheral portion of the lower cap is rotatably coupled to a guide boss at an outer peripheral portion of the dual container body.

5. The dissimilar contents mixing cosmetic container of claim 4, wherein a catching member comprising a opened recess and catching bosses is provided at an inner central portion of the lower cap.

6. The dissimilar contents mixing cosmetic container of claim 1, wherein the dissimilar contents receiving means is coupled to an inner diameter of the dual container body, a lower end of the dissimilar contents receiving means is coupled to an interior of the lower cap, the second content are received in the dissimilar contents receiving means, and the mixing member raising a piston by a resilient force caused by releasing a fixed state when the lower cap is rotated is provided in the dissimilar contents receiving means.

7. The dissimilar contents mixing cosmetic container of claim 6, wherein the dissimilar contents receiving means comprises a second content housing for receiving second content, a piston for raising and discharging the contents while maintaining sealing of the second content, and a mixing member provided within the piston, having a perforation pin at an upper central portion thereof, receiving a resilient member at a lower side thereof, and comprising a catching step at a lower end thereof.

8. The dissimilar contents mixing cosmetic container of claim 1, wherein the dissimilar contents receiving means located at a lower side of the dual container body comprises a second content housing for receiving second content, and a piston for raising and discharging the contents while maintaining sealing of the second content;

wherein the mixing member is provided within the piston, has a perforation pin at an upper central portion thereof, receives the resilient member at a lower side thereof, and comprises a catching step at a lower end thereof;

wherein a catching member formed to correspond to the catching step is formed at a center of the second content housing;

wherein a pushing pressing member, which divides the catching member into opposite sides when an upward artificial force is pressed while being on standby at a lower end of the mixing member, to release braking of the mixing member, so as to raise the mixing member is provided at a lower end of the mixing member; and wherein the pushing pressing member raises the mixing member, and then is pushed and lowered by the catching member while going back to its original state by a resilient force of the catching member, and a catching step provided in a rib of the pushing pressing member is braked by a braking step provided in a lower cap.

9. The dissimilar contents mixing cosmetic container of claim 1, wherein the first content receiving means comprises a perforation pin guide member, and the perforation pin guide member presses the sealing plate downward and fixes the sealing plate while being coupled to the dissimilar contents sealing member.

10. The dissimilar contents mixing cosmetic container of claim 1, wherein the dissimilar contents receiving means comprises a second content housing for receiving second content, a piston for raising and discharging the second contents while maintaining sealing of the second content, and a mixing member provided within the piston, having a perforation pin at an upper central portion thereof, receiving a resilient member at a lower side thereof, and comprising a catching step at a lower end thereof.

* * * * *